United States Patent [19]

Ehret

[11] 4,284,931

[45] Aug. 18, 1981

[54] OVERSPEED SHUTDOWN SYSTEM FOR CENTRIFUGE APPARATUS

[75] Inventor: Robert J. Ehret, Los Altos, Calif.

[73] Assignee: Beckman Instruments, Inc., Fullerton, Calif.

[21] Appl. No.: 20,390

[22] Filed: Mar. 14, 1979

[51] Int. Cl.[3] ..... H02P 3/08; H02P 3/18

[52] U.S. Cl. ..... 318/318; 318/314; 318/327; 318/490; 318/449

[58] Field of Search ..... 318/314, 318, 327, 328, 318/463, 464, 449, 490

[56] References Cited

U.S. PATENT DOCUMENTS

| | | | |
|---|---|---|---|
| 3,110,853 | 11/1963 | Jones | 318/318 |
| 3,361,949 | 1/1968 | Brown et al. | 318/314 |
| 3,436,637 | 4/1969 | Ehret | 318/318 |

OTHER PUBLICATIONS

Morgan, D., "Micropower Phase-Locked Loop Widens Designer's Choice," *Electronics,* 9-25-72, pp. 121-122.

*Primary Examiner*—David Smith, Jr.

*Attorney, Agent, or Firm*—R. J. Steinmeyer; F. L. Mehlhoff; Robert J. Stern

[57] ABSTRACT

In an overspeed protection system for a centrifuge apparatus of the type including a rotor driven by a drive motor, a transducer for providing a signal whose frequency is a function of the rotational speed of the centrifuge rotor, an oscillator for generating a reference signal having a predetermined frequency, means for mixing the rotational speed signal with the reference signal to provide a difference frequency signal, a filter coupled to the output of the mixing means for passing signals having frequencies below a predetermined frequency, and means coupled to the filter for disconnecting power to the drive motor in response to an output signal from the filter, there is disclosed an improvement comprising a frequency comparator responsive to the rotational speed signal and the reference signal for generating an overspeed signal when the frequency of the rotational speed signal exceeds the frequency of the reference signal, and means for combining the outputs of the filter and the frequency comparator at the input to the power disconnecting means.

4 Claims, 1 Drawing Figure

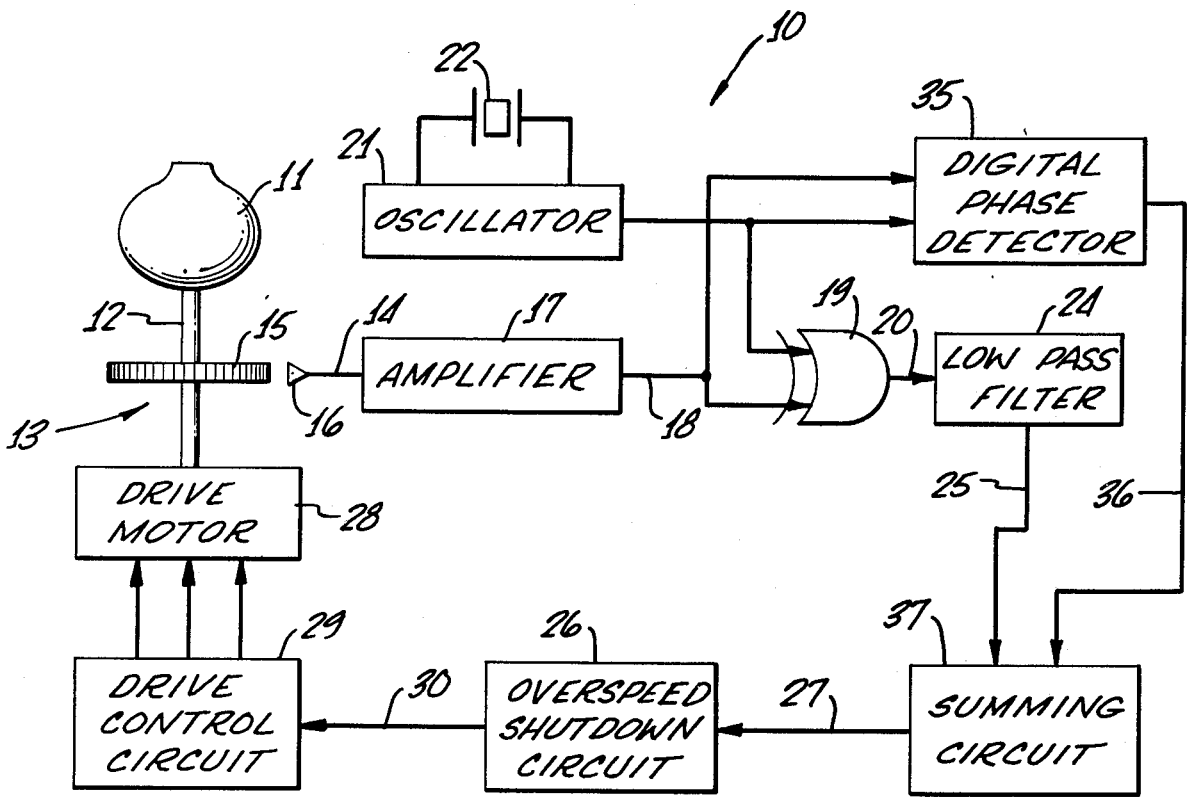
10
22
21
OSCILLATOR
35
DIGITAL PHASE DETECTOR
11
12
15
14
17
AMPLIFIER
19
20
24
LOW PASS FILTER
13
16
18
25
36
DRIVE MOTOR
28
29
26
37
DRIVE CONTROL CIRCUIT
30
OVERSPEED SHUTDOWN CIRCUIT
27
SUMMING CIRCUIT

OVERSPEED SHUTDOWN SYSTEM FOR CENTRIFUGE APPARATUS

BACKGROUND OF THE INVENTION

1. Field of the Invention

The present invention relates to an overspeed shutdown system for centrifuge apparatus and, more particularly, to an improved overspeed shutdown system for centrifuge apparatus which provides a sharper cutoff signal and a backup signal in the event the centrifuge rotor accelerates through the shutdown speed more rapidly than the normal shutdown circuitry can respond to.

2. Description of the Prior Art

A centrifuge apparatus generally has the capability of accepting rotors of many different speed ratings and sizes to fit the specific centrifuge application desired. Naturally, each rotor has its maximum speed rating and must be protected against overspeed and resulting damage.

Overspeed protection has been provided in the past to guard against either operator error or a malfunction of the speed control circuit. One type of overspeed protection system for centrifuge apparatus is described in my prior U.S. Pat. No. 3,436,637, issued Apr. 1, 1969. The system of such patent depends upon a beat frequency which approaches zero as the speed of the rotor approaches its maximum speed rating.

More specifically, the overspeed protection system for a centrifuge apparatus including a rotor driven by a drive motor according to my prior patent comprises a transducer for providing a signal whose frequency is a function of the rotational speed of the centrifuge rotor. A crystal controlled oscillator is provided for generating a reference signal having a predetermined frequency. A mixer responsive to the rotational speed signal and the reference signal provides a difference frequency signal. A low pass filter coupled to the output of the mixer passes signals having frequencies below a predetermined frequency. Means coupled to the filter disconnects power to the drive motor in response to an output signal from the filter.

Such an overspeed protection system inherently has some delay from the time the difference frequency signal falls below the predetermined frequency and the time that the power disconnecting means disconnects power to the drive motor. This delay results from the inclusion of the low pass filter. While this delay is of little concern in the case of large, heavy rotors which accelerate slowly, it is of great concern in the case of small, lightweight rotors which accelerate rapidly. That is, in the latter case, the rotor can accelerate past its maximum speed rating, to a point where the frequency difference between the rotational speed signal and the reference signal is greater than the predetermined frequency, faster than the power disconnecting means can respond. Since the low pass filter cannot distinguish between those cases when the rotational speed signal has a frequency greater than the frequency of the reference signal and when the rotational speed signal has a frequency below the frequency of the reference signal, there are times when an overspeed condition goes undetected with resultant damage to the centrifuge apparatus.

To prevent the above from occurring, it has been the practice heretofore to make the pass band of the low pass filter relatively wide to ensure that the power disconnecting means has adequate time to respond to the output of the filter as the beat frequency signal approaches zero and then increases away from zero. This is, however, an unacceptable solution to the problem since the result is that a shutdown signal will be generated at rotational speeds significantly lower than the maximum speed rating of the rotor. To the contrary, it is desirable to permit the rotor speed to come as close as possible to its maximum speed rating without generating an overspeed signal.

SUMMARY OF THE INVENTION

According to the present invention, these problems are solved in a manner unknown heretofore. That is, according to the present invention, the low pass filter may be constructed with an extremely narrow pass band so that under normal operating conditions, an overspeed shutdown signal will not be generated by the low pass filter until the rotational speed of the rotor reaches a speed which is extremely close to the maximum speed rating thereof. On the other hand, a frequency comparator is provided, responsive to the rotational speed of the rotor and the reference signal, for generating an output when the frequency of the rotational speed signal exceeds the frequency of the reference signal. While such a frequency comparator typically does not give a sharp, clean output for signals near the maximum speed rating of the rotor, such a frequency comparator does respond unambiquously when the rotational speed of the rotor exceeds the frequency of the reference signal. The output of the frequency comparator is combined with the output of the filter for application to the power disconnecting means.

Briefly, the present overspeed protection system for a centrifuge apparatus including a rotor driven by a motor comprises transducer means for providing a signal whose frequency is a function of the rotational speed of the centrifuge rotor, means for generating a reference signal having a predetermined frequency, means for mixing the rotational speed signal with the reference signal to provide a difference frequency signal, a filter coupled to the output of the mixing means for passing signals having frequencies below a predetermined frequency, means responsive to the rotational speed signal and the reference signal for generating an overspeed signal when the frequency of the rotational speed signal exceeds the frequency of the reference signal, and means coupled to the overspeed signal generating means and to the filter for disconnecting power to the drive motor in response to either an output signal from the filter or an overspeed signal from the overspeed signal generating means.

OBJECTS, FEATURES, AND ADVANTAGES

It is therefore an object of the present invention to provide an overspeed protection system for a centrifuge apparatus which will generate an overspeed signal for rotor speeds appreciaply greater than the maximum speed rating of the rotor. It is a feature of the present invention to generate such an overspeed signal by providing a frequency comparator which responds unambiguously to rotor speeds which are greater than the maximum speed rating of the rotor. An advantage to be derived is that the normal overspeed shutdown circuitry can be designed to prevent the generation of an overspeed shutdown signal until the rotational speed of the rotor closely approaches the maximum speed rating thereof. Another advantage is that damage to the rotor due to a rapidly accelerating rotor is prevented.

Still other objects, features, and attendant advantages of the present invention will become apparent to those skilled in the art from a reading of the following detailed description of the preferred embodiment constructed in accordance therewith, taken in conjunction with the accompanying drawing wherein:

BRIEF DESCRIPTION OF THE DRAWING

The sole FIGURE of drawings is a schematic diagram, partly in block form, of an overspeed shutdown system for centrifuge apparatus constructed in accordance with the teachings of the present invention.

DESCRIPTION OF THE PREFERRED EMBODIMENT

Referring now to the drawing, there is shown an overspeed shutdown system, generally designated 10, having a number of elements in common with the overspeed shutdown system of my prior U.S. Pat. No. 3,436,637. Those common elements will be described first.

More specifically, shutdown system 10 is designed for use with centrifuge apparatus including a rotor 11 having a corresponding maximum speed rating which is mounted for rotation on shaft 12. Mounted on rotor 11 or shaft 12 is transducer means, generally designated 13, for providing a signal on a line 14 whose frequency is a function of the rotational speed of rotor 11. Transducer means 13 may be a reflective disc 15 having alternate reflective and nonreflective sectors, the total number of sectors being related to the maximum speed of the rotor. Optical means 16 may include a light source (not shown) and a phototransistor (not shown) which cooperates with disc 15 for generating the signal on line 14. That is, as explained in my prior patent, the light source may be positioned to direct light toward the reflective sectors of disc 15, the phototransistor being positioned to respond to the reflected light. When the transistor has light impinging upon its receiver surface, it completes a circuit to energize an amplifier 17 connected to line 14. An alternating periodic waveform is thus produced which is related to the actual speed of rotor 11 and to the number of sectors in disc 15.

The output of amplifier 17, on a line 18, is connected to one input of an exclusive OR gate 19 which functions as a mixer. A stabilized, standard signal frequency is also coupled to OR gate 19 to produce a beat or difference frequency signal on a line 20. Such a stabilized, standard signal frequency may be derived from an oscillator 21 controlled by a crystal 22. The outputs of amplifier 17 and oscillator 21 are preferably relatively symmetrical square waves having a minimum of harmonics.

A low pass filter 24 is coupled to the output of gate 19 and is constructed to pass a frequency which is relatively low compared to the frequency of oscillator 21. In particular, low pass filter 24 is designed to pass the difference frequency output signal provided by gate 19 only when such signal falls below a predetermined minimum frequency. In my prior patent, it is disclosed that the pass band of filter 24 may be constructed to terminate at approximately 40 cycles per second. According to the present invention, the pass band of filter 24 may be constructed to terminate at a significantly lower frequency. In this manner, low pass filter 24 passes the difference frequency signal from gate 19 only when the speed of rotor 11 approaches a predetermined maximum speed since as the speed of rotor 11 increases, the frequency of the difference signal, which is the frequency difference between the frequency of the signal proportional to the speed of rotor 11 and the standard reference frequency signal derived from oscillator 21, derived from gate 19, decreases.

In my prior patent, the output of low pass filter 24, on a line 25, is coupled directly to an overspeed shutdown circuit 26. Overspeed shutdown circuit 26 may include a silicon controlled rectifier (not shown) having its activating gate coupled to the input 27 of circuit 26. Thus, when the difference frequency from gate 19 reaches a predetermined minimum, a trigger signal is produced by low pass filter 24 which activates the silicon controlled rectifier to complete a circuit to ground, which in turn causes the centrifuge apparatus to be shut down.

More specifically, the driving system for rotor 11 includes a drive motor 28 coupled to shaft 12 and controlled by a drive control circuit 29. The output of overspeed shutdown circuit 26 is conducted to drive control circuit 29 over a line 30 to remove power to drive control circuit 29 over a line 30 to remove power to drive motor 28 in the presence of an overspeed shutdown condition as sensed by filter 24.

It has been discovered during use of the overspeed shutdown system for centrifuge apparatus as just described, and as disclosed and claimed in my prior U.S. Pat. No. 3,436,637, that there are circumstances when overspeed shutdown circuit 26 will not deactivate drive control circuit 29 in the presence of an overspeed condition. This is because low pass filter 24 cannot distinguish between the circumstances when the frequency of oscillator 21 exceeds the frequency of amplifier 17 by an amount greater than the pass band of filter 24 and the circumstances when the frequency of oscillator 21 is less than the frequency of amplifier 17 by an amount greater than the pass band of filter 24. In other words, the system of my prior patent relies on filter 24 responding when the frequency of amplifier 17 approaches the frequency of oscillator 21 so that the beat frequency output of gate 19 is within the pass band of filter 24.

While it would seem that it would not be possible for the frequency of amplifier 17 to exceed the frequency of oscillator 21 by an amount greater than the pass band of filter 24 without overspeed shutdown circuit 26 from being activated by filter 24, this has proven in practice not to be the case. That is, low pass filter 24 inherently introduces some delay between the output of gate 19 and the input of overspeed shutdown circuit 26 and this can cause a malfunction under certain circumstances. That is, in the case of a small, lightweight centrifuge rotor, it is possible that motor 28 will accelerate such rotor to and beyond its maximum speed rating within a period of time which is too short for filter 24 to respond. This has occurred, resulting in overspeed and damage to the centrifuge.

In order to prevent the occurrence of the above circumstances, it has been the practice heretofore to widen the pass band of filter 24 to ensure that it will have adequate time to respond to overspeed conditions with all rotors used with system 10. However, the result of this is to cause an overspeed shutdown signal to be generated when the speed of centrifuge 11 is significantly lower than its maximum speed rating.

According to the present invention, the pass band of low pass filter 24 may be made extremely narrow, significantly narrower than the pass band disclosed in my prior patent, to ensure that an overspeed shutdown signal is not generated by filter 24 until centrifuge 11 reaches a speed which is extremely close to its maximum speed rating. In addition, in order to prevent an overspeed condition which is missed by filter 24, the outputs of oscillator 21 and amplifier 17 are applied to a frequency comparator 35. Since amplifier 17 and oscillator 21 preferably produce symmetrical square wave outputs, frequency comparator 35 is preferably a digital phase detector, such as the type CD 4046 integrated circuit manufactured by RCA Corporation. The output of frequency comparator 35 will have one polarity if the frequency of the signal from oscillator 21 exceeds the frequency of the signal from amplifier 17 and will have the opposite polarity if the frequency of the signal from amplifier 17 exceeds the frequency of the signal from oscillator 21.

Such a frequency comparator circuit typically does not give a sharp, clean output for signals having approximately the same frequency and phase. However, such a circuit does provide a clear indication when the frequency of amplifier 17 exceeds the frequency of oscillator 21. Accordingly, the output of frequency comparator 35 on line 36 is applied to a summing circuit 37 together with the output of low pass filter 24 on line 25, the output of summing circuit 37 being connected to the input 27 of overspeed shutdown circuit 26.

In operation, assuming that the centrifuge apparatus is operating properly during initial acceleration of centrifuge rotor 11, the output of amplifier 17, when coupled into exclusive OR gate 19 together with the output of oscillator 21, will produce a difference frequency signal on line 20 which is a relatively high frequency. At this point, low pass filter 24 will have no output. In addition, since the frequency of oscillator 21 will be significantly higher than the frequency of amplifier 17, there will, for example, be a negative polarity output on line 36 from frequency comparator 35 and shutdown circuit 26 may be adjusted so as to respond only to positive polarity signals from comparator 35.

If, due to a malfunction of the drive circuit or an error in the setting of the speed control for the centrifuge apparatus, the speed of rotor 11 exceeds the maximum rated speed, low pass filter 24 will initially sense a very low frequency difference to activate overspeed shutdown circuit 26 via summing circuit 37. If, on the other hand, the overspeed condition causes the difference frequency at the output of gate 20 to exceed the pass band of low pass filter 24 so that it has no output, this overspeed condition will cause a positive polarity output to appear at the output of detector 35. This output on line 36 is conducted to overspeed shutdown circuit 26 via summing circuit 37 to shut down drive control circuit 29.

While the invention has been described with respect to the preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

I claim:

1. An overspeed protection system for a centrifuge apparatus including a rotor driven by a drive motor comprising:

transducer means for providing a signal whose frequency is a function of the rotational speed of said centrifuge rotor;

means for generating a reference signal having a predetermined frequency;

means for mixing the rotational speed signal with the reference signal to provide a difference frequency signal;

a filter coupled to the output of said mixing means for passing signals having frequencies below a predetermined frequency;

means responsive to said rotational speed signal and said reference signal for generating an overspeed signal when the frequency of said rotational speed signal exceeds the frequency of said reference signal; and means coupled to said overspeed signal generating means and to said filter for disconnecting power to said drive motor in response to either an output signal from said filter or an overspeed signal from said overspeed signal generating means.

2. An overspeed protection system according to claim 1, wherein said mixing means comprises:

an exclusive OR gate.

3. An overspeed protection system according to claim 1 or 2, wherein said overspeed signal generating means comprises:

a digital phase detector.

4. In an overspeed protection system for a centrifuge apparatus including a rotor driven by a drive motor, transducer means for providing a signal whose frequency is a function of the rotational speed of said centrifuge rotor, means for generating a reference signal having a predetermined frequency, means for mixing said rotational speed signal with said reference signal to provide a difference frequency signal, a filter coupled to the output of said mixing means for passing signals having frequencies below a predetermined frequency, and means coupled to said filter for disconnecting power to said drive motor in response to an output signal from said filter, the improvement comprising:

frequency comparator means responsive to said rotational speed signal and said reference signal for providing an overspeed signal when the frequency of said rotational speed signal exceeds the frequency of said reference signal; and means for conducting said overspeed signal to said power disconnecting means for disconnecting power to said drive motor in response to an overspeed signal from said frequency comparator means.

* * * * *